US005462382A

United States Patent [19]

Sauerwein et al.

[11] Patent Number: 5,462,382

[45] Date of Patent: Oct. 31, 1995

[54] SURFACE DRAINAGE APPARATUS

[75] Inventors: Heinrich Sauerwein, Nubbel; Wolfgang Arm, Rendsburg, both of Germany

[73] Assignee: ACO Severin Ahlmann GmbH & Co., KG, Rendsburg, Germany

[21] Appl. No.: 162,337

[22] Filed: Dec. 3, 1993

[30] Foreign Application Priority Data

Dec. 10, 1992 [DE] Germany ..... 42 41 705.8
Aug. 18, 1993 [DE] Germany ..... 43 27 810.8

[51] Int. Cl.[6] ..... E01F 5/00

[52] U.S. Cl. ..... 404/2; 404/4; 49/463

[58] Field of Search ..... 404/2, 3, 4, 5; 52/169.5, 11, 20; 49/463, 465, 41; 24/666, 668, 297; 411/508, 509, 510, 338, 339

[56] References Cited

U.S. PATENT DOCUMENTS 1,693,190 11/1928 Benedetti ..... 49/465
1,877,996 9/1932 Shanley ..... 49/465
2,535,275 12/1950 Dixon ..... 49/465
3,201,161 8/1965 Castle ..... 292/173
4,630,962 12/1986 Thomann et al. ..... 404/2

FOREIGN PATENT DOCUMENTS

0204278A2 10/1986 European Pat. Off. .

*Primary Examiner*—Ramon S. Britts
*Assistant Examiner*—Pamela A. O'Connor
*Attorney, Agent, or Firm*—Marshall, O'Toole, Gerstein, Murray & Borun

[57] ABSTRACT

Surface drainage apparatus comprises a channel body defining a drainage channel with a cover defining apertures through which drainage can pass into the drainage channel. A fixing means for attachment of the cover to the channel body is provided and comprises a first fixing element for attachment to said channel body and a complementary second fixing element for attachment to said cover. The second fixing element comprises a bolt that is mounted in the cover so as to be capable of sliding into a locking position in the direction toward a long edge defined by said cover and back out of this locking position into an opened position. The first fixing element comprises a retaining means which when the bolt slides into the locking position engages with the bolt in such a way that said cover is retained on the channel body.

17 Claims, 5 Drawing Sheets

SURFACE DRAINAGE APPARATUS

FIELD OF THE INVENTION

The present invention relates to surface drainage apparatus.

DESCRIPTION OF THE PRIOR ART

Drainage channels with covers are known in which the cover is fixed to the channel body, usually via a frame on the upper edge of the channel body, by means of screws. Both manufacture and assembly of these conventional channels are relatively laborious.

In European patent EP 204 278 A2 is described a surface drainage apparatus in which a wedge device is provided to fix the cover to the channel. Although this kind of fixation is simpler than fixation by means of screws, the whole arrangement is relatively expensive to manufacture.

SUMMARY OF THE INVENTION

The object of the present invention is to provide a surface drainage apparatus wherein the manner in which the cover is fixed to the channel body is simpler than hitherto.

According to the present invention there is provided surface drainage apparatus comprising a channel body defining a drainage channel, a cover for the drainage channel defining apertures through which drainage can pass into said drainage channel, a fixing means for attachment of said cover to said channel body and comprising a first fixing element for attachment to said channel body and a complementary second fixing element for attachment to said cover, said second fixing element comprising a bolt that is mounted in said cover so as to be capable of sliding into a locking position in the direction toward a long edge defined by said cover and back out of this locking position into an opened position, and said first fixing element comprising a retaining means which when said bolt slides into said locking position engages with said bolt in such a way that said cover is retained on said channel body.

Thus in the present invention screwless fixation of the cover is accomplished by a bolt which is mounted in the cover and which is slidable toward a long edge of the cover, into a locking position, and out of this position into an opened position. On the body is located a retaining means which engages with the bolt when the bolt is slid into the locking position in such a way that the cover is held on the body. Such a bolt is relatively simple to manufacture and to connect captively to the cover.

Preferably, the bolt comprises a catch spring that engages the cover by interlocking with a notch defined by the cover in such a way that the bolt is thereby restrained in either the locking position or the opened position, or both, against movement. As a result unintentional opening or removal of the cover is impossible.

The bolt is preferably mounted in one of the apertures of the cover that serve as an inlet for the drainage water to the drainage channel. Thus the cover is not additionally weakened.

Preferably also, the bolt defines an opening which, when it is in the locking position, together with the aperture in which it is disposed forms a composite opening the area of which is substantially equal to that of the other apertures defined by the cover. One result of this is to satisfy the aesthetic requirements, and another is to avoid reducing the influx cross-section for the intake of water.

Preferably also, the aperture in which the bolt is disposed has the form of a slot open toward a long edge defined by said cover. With this arrangement, the bolt can be pushed into the opening from outside.

Preferably also, the bolt comprises a cover plate which in the locking position closes off the slot up to the long edge. This ensures that the surface of the cover is uniform, with no depressions, so that no dirt can collect.

Preferably also, after installation of the apparatus a top surface of the bolt is recessed below a top surface of the cover by an amount sufficient that when a vehicle is driven over the cover no load is imposed on the bolt means. Usually fractions of a millimeter suffice for this purpose. This ensures that the guides through which the bolt slides always allow free passage.

Preferably also, the bolt is of substantially I-shaped cross section in a plane perpendicular to its sliding direction and the aperture in the cover is correspondingly formed in that it comprises rails that are enclosed by the bolt.

Preferably also, the bolt comprises a clearing means for clearing dirt away from the slide path of said bolt means during opening, as the bolt slides from said locking position into said opened position. The bolt can thereby easily be opened even after prolonged use. The clearing means are particularly simple to construct when they comprise beveled surfaces to raise the dirt during sliding. The dirt is therefore not compacted but instead is actually cleared out of the way.

Preferably also, the retaining means comprises a lug that projects into a retaining recess defined by said cover in the region of said bolt, and wherein said bolt comprises a retaining section that can extend under said lug. Such a lug can very easily be cast integrally with a frame attached to the channel body in which the cover locates. The lug and the retaining recess are preferably complementarily shaped so that displacement of the cover in a direction of the long edge, i.e. in the long direction of a drainage channel, is prevented. The fixing mechanism to fasten the cover over the drainage channel hence simultaneously secures the cover against slippage along the channel.

Preferably also, the cover comprises two long edges and defines a plurality of openings spaced along these long edges, and a plurality of hook-in elements are provided on the channel body which engage in the openings when the cover is set into place on said channel body. With this arrangement, fewer bolts are needed to provide secure retention of the cover on the channel body. In addition, the hook-in elements and the openings are disposed symmetrically on the channel body and the cover respectively in such a way that the cover can be set in place on the channel body in either of two ways round. Placement of the cover on the channel body is thereby facilitated.

The invention will now be described by way of example with reference to the accompanying drawings.

DESCRIPTION OF THE PREFERRED EMBODIMENTS

Figure 2:
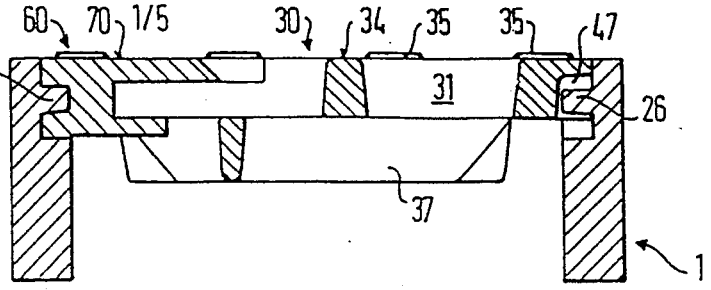
FIG. 2 is a sectional view along the line II—II in FIG. 1.

As shown in the enclosed drawings, a cover 30 is placed on a drainage channel body 1. The cover 30 defines apertures 31, 31' in the form of slots, which are separated from one another by ribs 37.

The cover 30 defines two opposite long edges 32, 32'. One of these long edges 32' is provided with hook-in openings 39 comprising recesses in the surface of the cover 30. Retaining pieces 29 are located under the hook-in openings and the channel body is provided with hook-in elements 13, which insert into the hook-in openings 39 and thereby become apposed to the retaining pieces 29. Along the other long edge 32 the cover 30 is provided with openings 39' that pass through the whole cover 30, so that on this long edge 32 there are no retaining pieces 29.

In the embodiment in the drawings, two spaced apertures 31 formed in the cover 30 are extended to the long edge 32 by way of a slot 33. At its end toward the edge 32 this slot 33 forms a retaining recess 38, which is shaped so that the lug 26 on the channel is held within it in a substantially form-fitting manner. This arrangement effectively prevents the cover 30 from being displaced in the long direction of the channel.

As shown in FIG. 2, there is an open space above and below the lug 26.

The slot 33 or the associated aperture 31 is provided with guide rails 36, 36' that project inward into the slot 33 or the opening 31. The rails 36, 36' are provided with notches 68.

Figure 7:
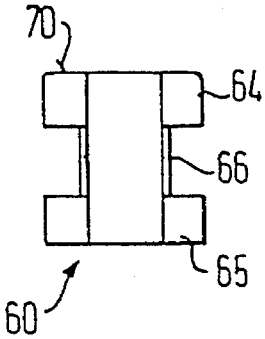
FIG. 7 is a front elevation of the bolt along the line VII—VII in FIG. 6.
Figure 8:
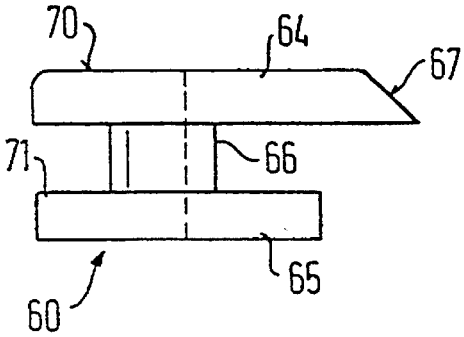
FIG. 8 is a side elevation of the bolt along the line VIII—VIII in FIG. 6.

Into each of the apertures 31 provided with the slots 33 there is inserted a bolt 60, which has a substantially I-shaped cross section as shown in FIGS. 7 and 8. In particular, the bolt 60 comprises an upper cover plate 64 and a floor plate 65, which is connected to and separated from the cover plate 64 by a neck 66.

Figure 1:
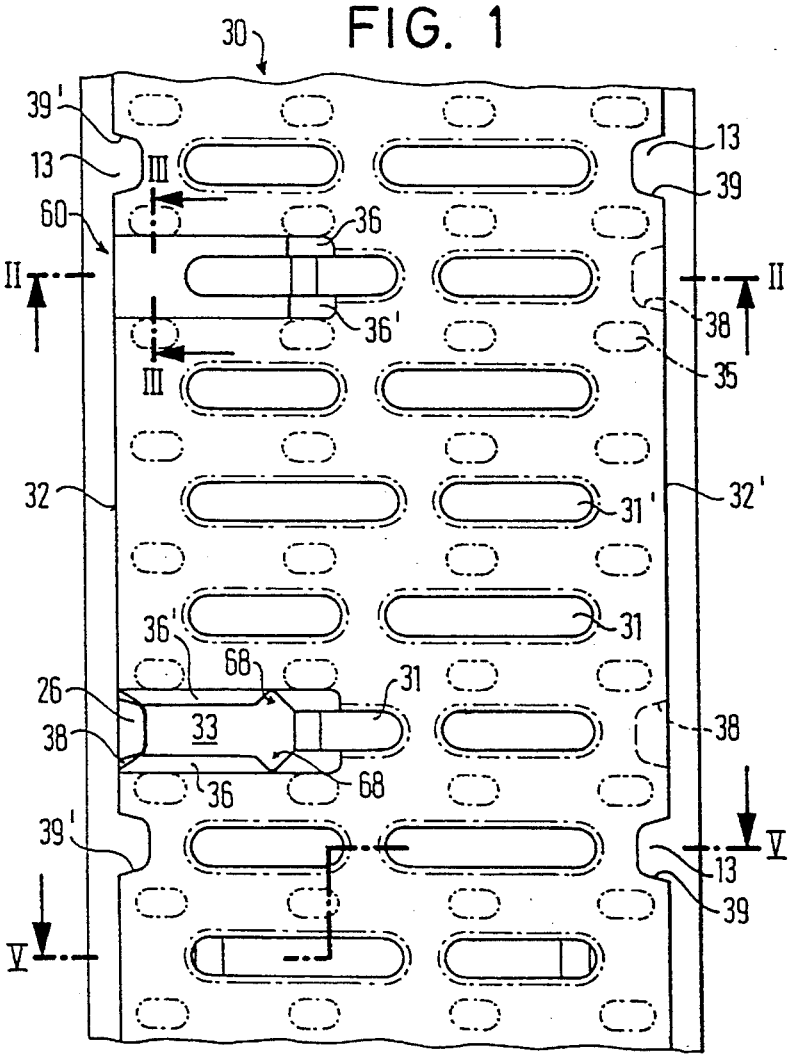
FIG. 1 is a partial plan view of a surface drainage apparatus with a cover in place according to the present invention.
Figure 3:
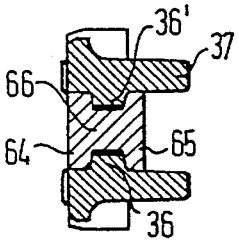
FIG. 3 is a sectional view along the line III—III in FIG. 1.
Figure 4:
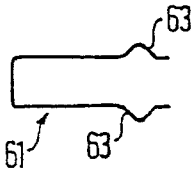
FIG. 4 is a plan view of a catch spring.

At its end toward the long edge 32, the neck 66 is set back with respect to both the floor plate 65 and the cover plate 64 by a distance such as to form a retaining section 71 that can extend under the lug 26. The cover plate 64 is extended outward, toward the long edge 32, far enough that when the bolt 60 is in a locking position as shown in FIG. 1, the end of the cover plate 64 is substantially flush with the long edge 32.

At its end away from the long edge 32, the cover plate 64 is provided with beveled surfaces 67, so that during sliding of the bolt 60 (to the right in FIG. 1), dirt on the rails 36, 36' can be lifted off.

Figure 9:
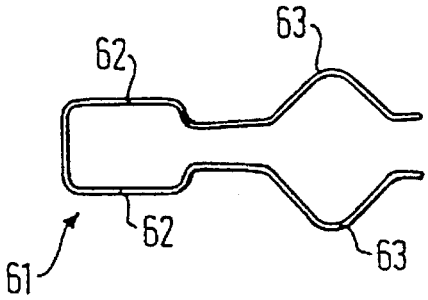
FIG. 9 is a plan view of a second preferred embodiment of catch spring.

To secure the bolt 60 in its locking position as well as in its opened position, a catch spring 61 is provided, with a retaining portion 62 (see FIG. 9) that encloses the neck 66. At its end the catch spring 61 comprises outwardly curved portions 63, which engage the notches 68 when the bolt 60 is in its locking position.

Figure 6:
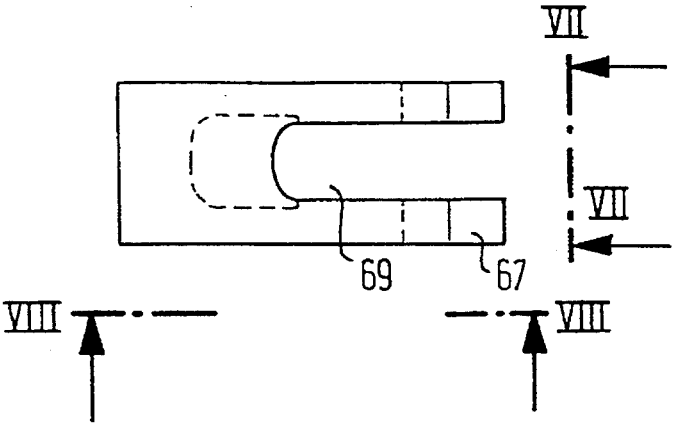
FIG. 6 is a plan view of a bolt.

The bolt 60 also defines an opening 69, so that its ends, between the beveled surfaces 67, define a forklike configuration. The opening 69 is so constructed that the total area of the composite opening formed by the opening 69 and the residual region of the aperture 31 with slot 33 corresponds to the area of the other apertures 31 in the cover 30. This can be seen in FIGS. 1, 6, and 8.

The surface 70 of the cover plate 64, as shown in FIGS. 2 and 8, is somewhat lower than the surface of the cover 30, so that when vehicles are driven over the cover 30, no force acts on the bolt 60 or its surface 70. Moreover, the cover 30 is formed with knobs 35 that project above its surface 34, which both help to prevent skidding and reduce load imposed on the bolt 60 by crossing traffic.

The bolt 60 is preferably made of high-stability metal, for example of an aluminum diecast alloy, with its surface passivated to avoid corrosion.

As shown in the drawings, the channel body 1 is identical or symmetrical on both sides with respect to the lugs 26. Accordingly, along the long edge 32', opposite the long edge 32 at which the bolts 60 are situated, cavities 47 are provided to make room for the lugs 26 that are not actually needed on the long edge 32'. This arrangement ensures that the cover 30 can be placed on the channel 1 in any desired orientation.

Figure 5:
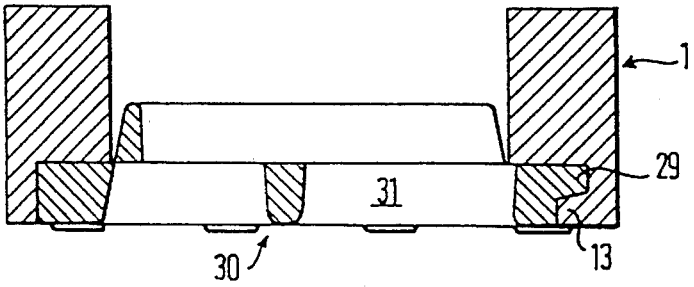
FIG. 5 is a sectional view along the line V—V in FIG. 1.

The procedure by which a cover 30 as shown in FIGS. 1, 2, and 5 is fitted to first tilt the cover 30 and hook it under the hook-in elements 13 by means of the retaining pieces 29. Then, with the bolts 60 slid back (to the right as shown in FIG. 1), the cover 30 is set completely in place, after which the bolts 60 are closed (slid to the left as shown in FIG. 1) until the curved portions 63 of the catch springs 61 engage with the notches 68. In this position the retaining sections 71 of the bolts 60 are seated under the lugs 26, so as effectively to prevent the cover 30 from being lifted away from the channel body 1 or the frames 10, 10'. The cover is removed by proceeding in a reverse sequence.

In FIGS. 10 to 13 a first embodiment of a cover in the form of a grating 101 is shown. Here, the grating 101 comprises first and second seat engaging portions 105, 106 located respectively, one at either side of the grating 101. They are spaced apart and are arranged parallel to one another in the long direction of the grating 101. The grating 101 is seated, as shown schematically in FIG. 13, by means of its seat engaging portions 105 and 106 on a drainage channel body as indicated in dashed lines.

The two seat engaging portions 105 and 106 are connected to one another by a plurality of ribs 107 that are separated from one another in the long direction of the grating 101. In the spaces between the ribs 107 inlet slots 109 are formed, which are described further below. On the undersides of the ribs 107 supporting sections 115 are provided, which extend down into the drainage channel, their height being greater than the thickness of the seat-engaging portions 105, 106. In the embodiment shown in FIGS. 12 and 13, the supporting sections 115 extend substantially from the region of one seat-engaging portion 105 to the region of the opposite seat-engaging portion 106, reinforcing the ribs 107 in such a way that even when an extremely large load is imposed on the individual ribs 107 there is no risk that the individual ribs 107 will break or that the grating 101 will be damaged.

Figure 10:
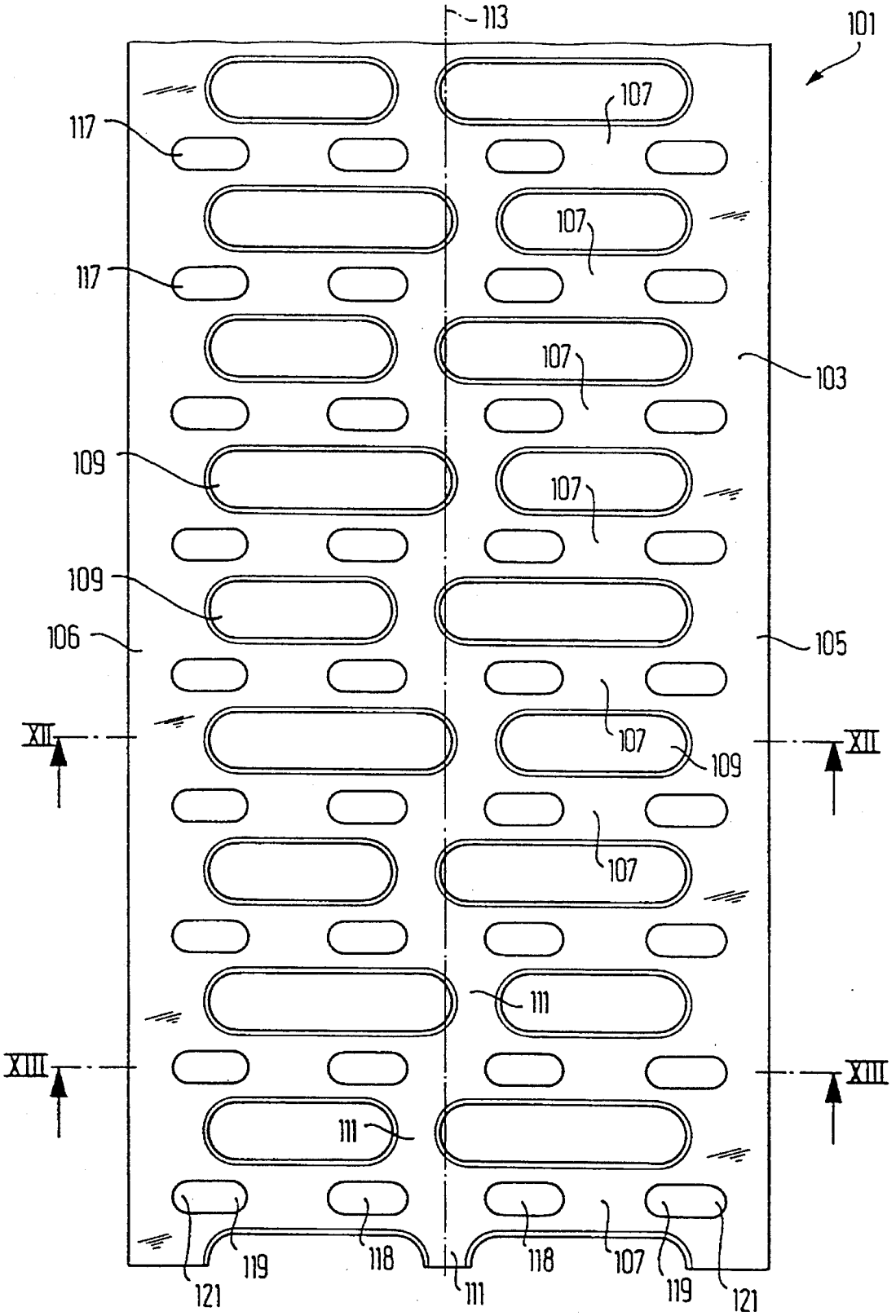
FIG. 10 is a schematic partial plan view of a first embodiment of cover in the form of a grating.
Figure 11:
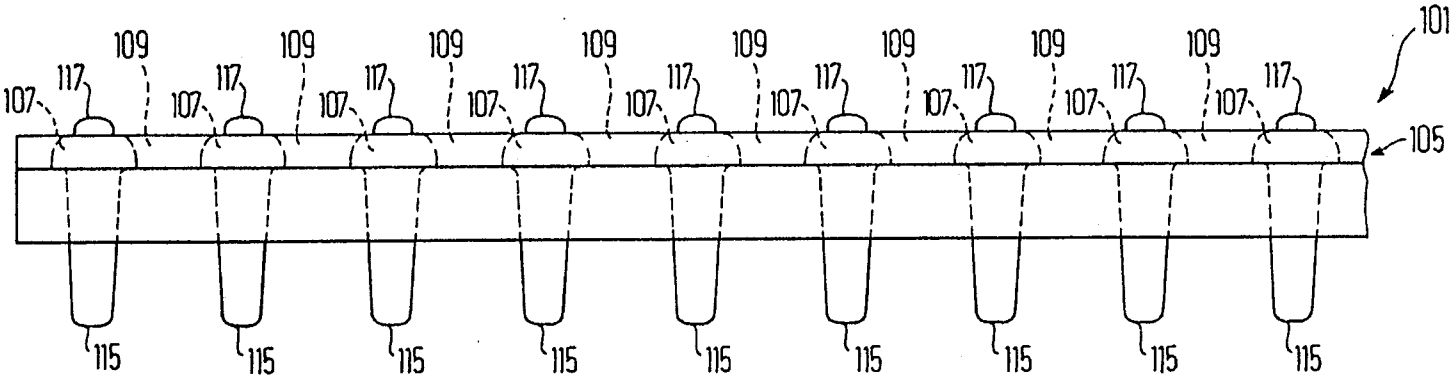
FIG. 11 is a schematic side view of the grating shown in FIG. 10.
Figure 12:
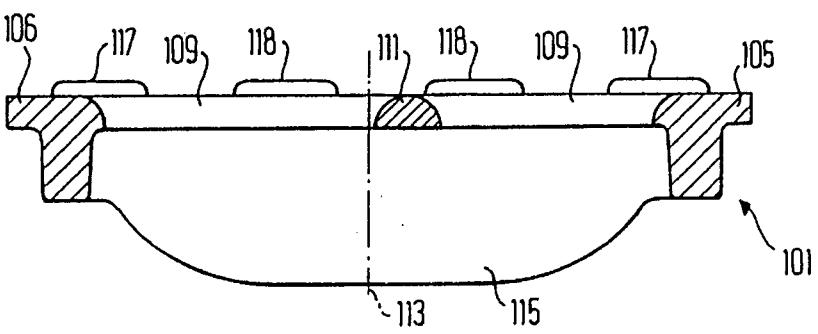
FIG. 12 is a schematic cross-section along the line XII—XII in FIG. 10.

Between the ribs 107, bridge sections 111 are provided each of which connects two adjacent ribs 107 to one another. The bridge sections 111 divide the inlet slots 109 located between any two adjacent ribs 107 into two inlet-slot divisions, as shown in FIGS. 10 and 12, in such a way that owing to the off-center arrangement of the bridge sections 111 the two inlet-slot divisions 109 are of different lengths. The bridge sections 111 are displaced towards the first and second seat engaging portions 105, 106 in alternation so that longer and shorter inlet slots alternate along the longitudunal axis of the grating 101.

In particular in the first embodiment shown in FIGS. 10 to 13, the bridge sections are arranged in such a way that their edges toward the first and second seat-engaging portions 105, 106 in alternation are substantially contiguous with a hypothetical line 113 drawn along the long direction of the grating. As a result, a meandering path is formed that passes between the inlet-slot divisions and is composed of consecutive bridge sections 111 plus the adjacent ribs 107.

This particular structural design has proved extremely stabilizing so that the present grating 1, reinforced owing to the particular arrangement of the bridge sections 111, is considerably more stable than a conventional grating and hence can bear greater loads without damage to the grating or to the individual ribs. At the same time, its drainage function is improved in situations when there is a great overflow of water.

On the surface 103 of of the grating that is exposed to pedestrian and vehicular traffic, as shown in FIGS. 10 to 13, there are disposed a plurality of knobs 117, 118 that project upward and enhance the non-skid properties of the grating 1.

Figure 13:
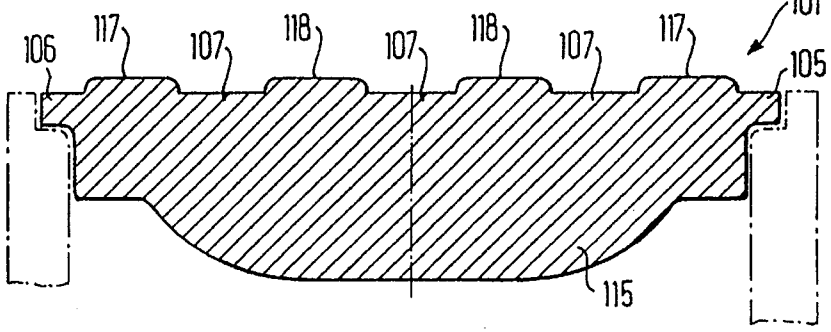
FIG. 13 is a schematic cross-section along the line XIII—XIII in FIG. 10.

Here two kinds of knobs are distinguished. The first knobs 117 are disposed in the regions of the seat-engaging portions 105, 106 in such a way that an outer part 121 of the knob extends over the seat-engaging portion 105 or 106 and an inner part 119 extends over the associated rib 107. This is shown in FIGS. 12 and 13. These knobs 17 serve to additionally reinforce the transition regions between the seat-engaging portions 105, 106 and the ribs 107, also providing an increase in stability.

The second kind of knob 118 achieves the same effect in the regions where the bridge sections 111 join the ribs 107, that is at the transition regions. As shown in FIG. 10, the second knobs 118 are also disposed on the ribs 107, in alignment with the first knobs 117, the inner parts of each of the knobs being disposed in a transition region of at least one bridge section 111 and the outer parts of the knobs barely not overlapping the transition region. In this way the transition region between bridge sections 111 and ribs 107 is reinforced.

It will be appreciated that the aforementioned reinforcement measures, namely the relative positions of the knobs and the arrangement of the bridge sections offset from one another, can be provided either separately or in combination.

Each of these measures, by achieving a gain in the stability of the grating, makes it possible, for example, to make the supporting sections 115 narrower, which saves material and hence results in reduced productions costs. Moreover, there is no risk that the grating described above or its individual ribs will be damaged, even by an unusually great load.

Figure 14:
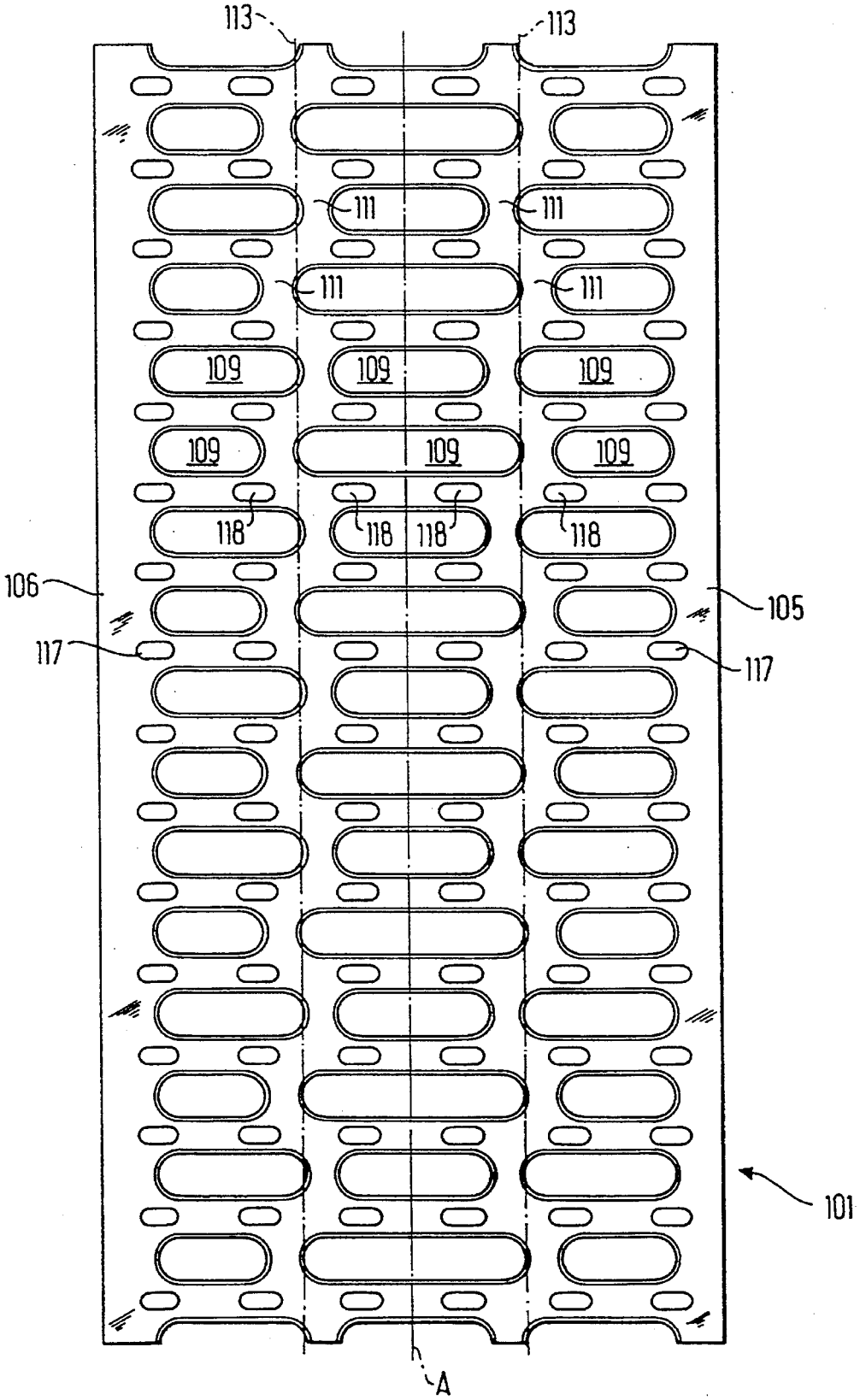
FIG. 14 is a schematic plan view of a second embodiment of grating

In FIG. 14 a second embodiment of a grating is shown, which is applicable particularly to wider configurations of drainage apparatus.

In this second embodiment, again the grating 101 comprises first and second seat-engaging portions 105, 106 that are connected by ribs 107 spaced apart from one another in the long direction of the grating.

The difference between this embodiment and the first lies in the fact that here two adjacent ribs 107 are connected not by one bridge section 111 but two bridge section 111. Hence each inlet slot 109 is subdivided into three inlet-slot divisions.

Because every two adjacent ribs 107 are connected by two bridge sections 111, two meandering paths are formed which wind between the inlet-slot divisions in the long direction of the grating 101. The two meandering paths lie on substantially parallel lines and are mirror-inverted with respect to one another about a median line of symmetry A.

The bridge sections 11 associated with a meandering path are arranged with respect to one another in a similar way to the bridge sections in the first embodiment. In particular, their edges toward the first and the second seat-engaging portions 105, 106 in alternation are substantially contiguous with a line 113.

The bridge sections 11 associated with the other meandering path are arranged similarly with respect to one another.

What is claimed is:

1. Surface drainage apparatus comprising a channel body defining a drainage channel, a cover for the drainage channel defining apertures through which drainage can pass into said drainage channel, a fixing means for attachment of said cover to said channel body and comprising a first fixing element for attachment to said channel body and a complementary second fixing element for attachment to said cover, said second fixing element comprising a bolt that is mounted in said cover so as to be capable of sliding into a locking position in the direction toward a long edge defined by said cover and back out of this locking position into an opened position, and said first fixing element comprising a retaining means which when said bolt slides into said locking position engages with said bolt in such a way that said cover is retained on said channel body.

2. Apparatus as claimed in claim 1, wherein said bolt comprises a catch spring that engages said cover by interlocking with a notch defined by said cover in such a way that said bolt is thereby restrained in said locking position against movement.

3. Apparatus as claimed in claim 1, wherein said bolt comprises a catch spring that engages said cover by interlocking with a notch defined by the cover in such a way that said bolt is thereby restrained in said opened position against movement.

4. Apparatus as claimed in claim 1, wherein said bolt is mounted in one of said apertures of the cover.

5. Apparatus as claimed in claim 4, wherein said bolt has an opening which, when said bolt is in said locking position, together with said one aperture in which said bolt is disposed forms a composite opening the area of which is substantially equal to that of said other apertures defined by said cover.

6. Apparatus as claimed in claim 4, wherein said aperture in which said bolt is disposed has the form of a slot open toward a long edge defined by said cover.

7. Apparatus as claimed in claim 6, wherein said cover further comprises a cover plate and bolt, wherein when the bolt is in said locking position, said bolt closes off said slot up to said long edge.

8. Apparatus as claimed in claim 1, wherein after installation of said apparatus a top surface of said bolt is recessed below a top surface of said cover by an amount sufficient that when a vehicle is driven over said cover a load imposed on said bolt is greatly reduced.

9. Apparatus as claimed in claim 4, wherein said bolt is of substantially I-shaped cross section in a plane perpendicular to its sliding direction and said one aperture in said cover is correspondingly formed.

10. Apparatus as claimed in claim 4, wherein said bolt comprises a clearing means for clearing dirt away from the slide path of said bolt during opening, as the bolt slides from said locking position into said opened position.

11. Apparatus as claimed in claim 10, wherein said clearing means comprises at least one beveled surface to lift up the dirt during sliding of said bolt.

12. Apparatus as claimed in claim 1, wherein said retaining means comprises a lug that projects into a retaining recess defined by said cover in the region of said bolt, and wherein said bolt comprises a retaining section that can extend under said lug.

13. Apparatus as claimed in claim 12, wherein said lug and said retaining recess are so complementarily shaped that displacement of said cover in a direction of said long edge is prevented.

14. Apparatus as claimed in claim 1, wherein said cover comprises two long edges and defines a plurality of openings spaced along these long edges, and wherein a plurality of hook-in elements are provided on said channel body which engage in said openings when said cover is set into place on said channel body.

15. Apparatus as claimed in claim 14, wherein said hook-in elements and said openings are disposed symmetrically on said channel body and said cover respectively in such a way that said cover can be set in place on said channel body in either of two orientations.

16. Apparatus as claimed in claim 1, wherein said cover defines two long edges comprising respectively a first and a second seating means, a plurality of ribs are provided connecting said first and said second seating means transversely with respect to a longitudinal axis of said drainage channel, said ribs being spaced apart to define said apertures in the form of slots and being connected together by bridge sections, each adjacent two ribs define therebetween at least two said slots with said bridge sections disposed off-center with respect to said longitudinal axis, and said bridge sections between each adjacent two ribs are alternately displaced towards said first and second seating means in such a way that said at least two slots are unequal in length and, in a direction along said longitudinal axis, longer and shorter slots alternate with one another.

17. Apparatus as claimed in claim 1, wherein said cover defines two long edges comprising respectively a first and a second seating means, a plurality of ribs are provided connecting said first and said second seating means transversely with respect to a longitudinal axis of said drainage channel, said ribs being spaced apart to define said apertures in the form of slots, and a plurality of knobs are provided projecting upward above an upper surface of said cover, each of said knobs extending so that one part thereof lies over one of said ribs and another part thereof lies over one of said first and said second seating means whereby transition regions of said cover defined between said ribs and said first and second seating means are reinforced by said knobs.

* * * * *